US009759081B2

(12) United States Patent
Morgan et al.

(10) Patent No.: US 9,759,081 B2
(45) Date of Patent: Sep. 12, 2017

(54) METHOD AND SYSTEM TO FACILITATE SEALING IN GAS TURBINES

(71) Applicant: General Electric Company, Schenectady, NY (US)

(72) Inventors: Victor John Morgan, Simpsonville, SC (US); Gregory Thomas Foster, Greer, SC (US); Neelesh Nandkumar Sarawate, Niskayuna, NY (US); David Wayne Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 836 days.

(21) Appl. No.: 14/049,020

(22) Filed: Oct. 8, 2013

(65) Prior Publication Data

US 2015/0098808 A1 Apr. 9, 2015

(51) Int. Cl.

| | |
|---|---|
| ***F01D 11/08*** | (2006.01) |
| ***F01D 9/04*** | (2006.01) |
| ***F01D 11/00*** | (2006.01) |

(52) U.S. Cl.

CPC ..... *F01D 11/08* (2013.01); *F01D 9/041* (2013.01); *F01D 11/003* (2013.01); *F05D 2230/60* (2013.01); *F05D 2260/38* (2013.01); *Y10T 29/4932* (2015.01)

(58) Field of Classification Search

CPC ..... F01D 11/003; F01D 11/08; F01D 11/005; F16J 15/024

See application file for complete search history.

(56) References Cited

U.S. PATENT DOCUMENTS

| | | | | |
|---|---|---|---|---|
| 4,063,845 | A * | 12/1977 | Allen | F01D 11/005 277/633 |
| 4,589,666 | A * | 5/1986 | Halling | F16L 51/025 277/631 |
| 5,657,998 | A * | 8/1997 | Dinc | F01D 11/005 277/653 |
| 5,934,687 | A * | 8/1999 | Bagepalli | F01D 11/005 277/637 |
| 6,076,835 | A | 6/2000 | Ress et al. | |
| 6,082,963 | A | 7/2000 | Sexton et al. | |
| 6,315,301 | B1 * | 11/2001 | Umemura | F01D 11/005 277/545 |
| 6,609,885 | B2 | 8/2003 | Mohammed-Fakir et al. | |
| 6,637,752 | B2 | 10/2003 | Aksit et al. | |
| 6,652,231 | B2 | 11/2003 | Vedantam et al. | |
| 6,682,300 | B2 | 1/2004 | Bolms | |
| 6,702,549 | B2 | 3/2004 | Tiemann | |

(Continued)

*Primary Examiner* — Justin Seabe

(74) *Attorney, Agent, or Firm* — Armstrong Teasdale LLP

(57) ABSTRACT

A method and system for sealing between components within a gas turbine is provided. A first recess defined in a first component receives a seal member. A second recess defined in a second component adjacent the first component also receives the seal member. The first and second recesses are located proximate a hot gas path defined through the gas turbine, and define circumferential paths about the turbine axis. The seal member includes a sealing face that extends in a direction substantially parallel to the turbine axis. The seal member also includes a plurality of seal layers, wherein at least one of the seal layers includes at least one stress relief region for facilitating flexing of the first seal member.

20 Claims, 7 Drawing Sheets

(56) References Cited

U.S. PATENT DOCUMENTS

| | | | | |
|---|---|---|---|---|
| 7,094,026 | B2 * | 8/2006 | Coign | F01D 9/023 415/189 |
| 7,140,840 | B2 | 11/2006 | Taillant et al. | |
| 7,549,845 | B2 * | 6/2009 | Uwami | F01D 11/008 277/630 |
| 7,901,186 | B2 | 3/2011 | Cornett et al. | |
| 2006/0239814 | A1 | 10/2006 | Uwami et al. | |
| 2007/0025841 | A1 | 2/2007 | Milazar | |
| 2010/0247300 | A1 | 9/2010 | Morgan | |
| 2012/0119447 | A1 | 5/2012 | Demiroglu et al. | |
| 2012/0133102 | A1 | 5/2012 | Samudrala et al. | |
| 2012/0183393 | A1 | 7/2012 | Demiroglu et al. | |
| 2012/0189435 | A1 | 7/2012 | Morgan et al. | |
| 2012/0211943 | A1 | 8/2012 | Hefner et al. | |

* cited by examiner

METHOD AND SYSTEM TO FACILITATE SEALING IN GAS TURBINES

FEDERAL RESEARCH STATEMENT

This invention was made with Government support under Contract No. DE-FC26-05NT42643, awarded by the Department of Energy (DOE), and the Government has certain rights in this invention.

BACKGROUND

The present disclosure relates generally to rotary machines, and, more specifically, to methods and systems for use in providing sealing between components within gas turbine engines.

At least some known rotary machines, such as gas turbines, include a plurality of seal assemblies in a fluid flow path to facilitate increasing the operating efficiency of the gas turbine. For example, some known seal assemblies are coupled between a stationary component and a rotary component to provide sealing between a high-pressure area and a low-pressure area. In addition, at least some known gas turbines include at least one stator vane assembly and at least one rotor blade assembly that collectively form a stage within the gas turbine. In at least some known gas turbines, seals are provided between static components in adjacent stages, or between components within a stage. However, such seals are located relatively remotely, in a radial direction, from an axis of rotation of the gas turbine. In at least some known gas turbines, there are components that are exposed to a flow of hot combustion gases, and that are fabricated from materials configured to withstand exposure to high temperatures. Moreover, in at least some known gas turbines, there are other components that, in ordinary operation of the gas turbine, are not directly exposed to hot combustion gases and are not fabricated from high temperature-resistant materials. To protect such areas of the gas turbine that are not high-temperature-resistant, sealing structures are provided to define a pressure boundary between high-temperature and lower-temperature areas. A cooling fluid (typically air) is supplied into the low-temperature, higher-pressure areas of the gas turbine on a side of the sealing structures opposite the lower-pressure hot combustion gas path. This cooling fluid (also sometimes referred to as purge air) is used to help prevent ingestion of combustion gases into the low-temperature areas of the gas turbine. The use of excessive amounts of purge air may result in a lowering of efficiency of the gas turbine.

BRIEF DESCRIPTION

In one aspect, a method for sealing between static components within a gas turbine is provided. The method includes defining a first recess in a first component in a gas turbine, wherein the first recess is located proximate a hot gas path defined through the gas turbine, and wherein the first recess defines a first circumferential path about a turbine axis. The method also includes defining a second recess in a second component located adjacent the first component, wherein the second recess is located proximate the hot gas path, and wherein the second recess defines a second circumferential path about the turbine axis. The method also includes orienting a first seal member within the first and second recesses. The first seal member includes a sealing face that extends in a direction substantially parallel to the turbine axis.

In another aspect, a system for sealing between components within a gas turbine is provided. The system includes a first recess defined in a first component in the gas turbine, wherein the first recess is located proximate a hot gas path defined through the gas turbine, and wherein the first recess defines a first circumferential path about a turbine axis. A second recess is defined in a second component in the gas turbine located adjacent the first component, wherein the second recess is located proximate the hot gas path, and wherein the second recess defines a second circumferential path about the turbine axis. A seal member is oriented within the first and second recesses. The seal member includes a sealing face that extends in a direction substantially parallel to the turbine axis.

In still another aspect, a gas turbine system is provided. The gas turbine system includes a compressor section, a combustor assembly coupled to the compressor section, and a turbine section coupled to the compressor section. The turbine section includes a sealing sub-system for use in sealing between a first component and a second component. The sealing sub-system includes a first recess defined in a first component in the turbine section, wherein the first recess is located proximate a hot gas path defined through the turbine section, and wherein the first recess defines a first circumferential path about a turbine axis. The sealing sub-system also includes a second recess defined in a second component adjacent the first component, wherein the second recess is located proximate the hot gas path, and wherein the second recess defines a second circumferential path about the turbine axis. The sealing sub-system also includes a seal member oriented within the first and second recesses. The seal member includes a sealing face that extends in a direction substantially parallel to the turbine axis, and a plurality of seal layers. The seal member also includes at least one stress relief region defined in at least one seal layer for facilitating flexing of the first seal member during orientation of the seal member within the first and second recesses.

DETAILED DESCRIPTION

As used herein, the terms "axial" and "axially" refer to directions and orientations extending substantially parallel to a longitudinal axis of a gas turbine engine. Moreover, the terms "radial" and "radially" refer to directions and orientations extending substantially perpendicular to the longitudinal axis of the gas turbine engine. In addition, as used herein, the terms "circumferential" and "circumferentially"

refer to directions and orientations extending arcuately about the longitudinal axis of the gas turbine engine. It should also be appreciated that the term "fluid" as used herein includes any medium or material that flows, including, but not limited to, gas and air.

Figure 1:
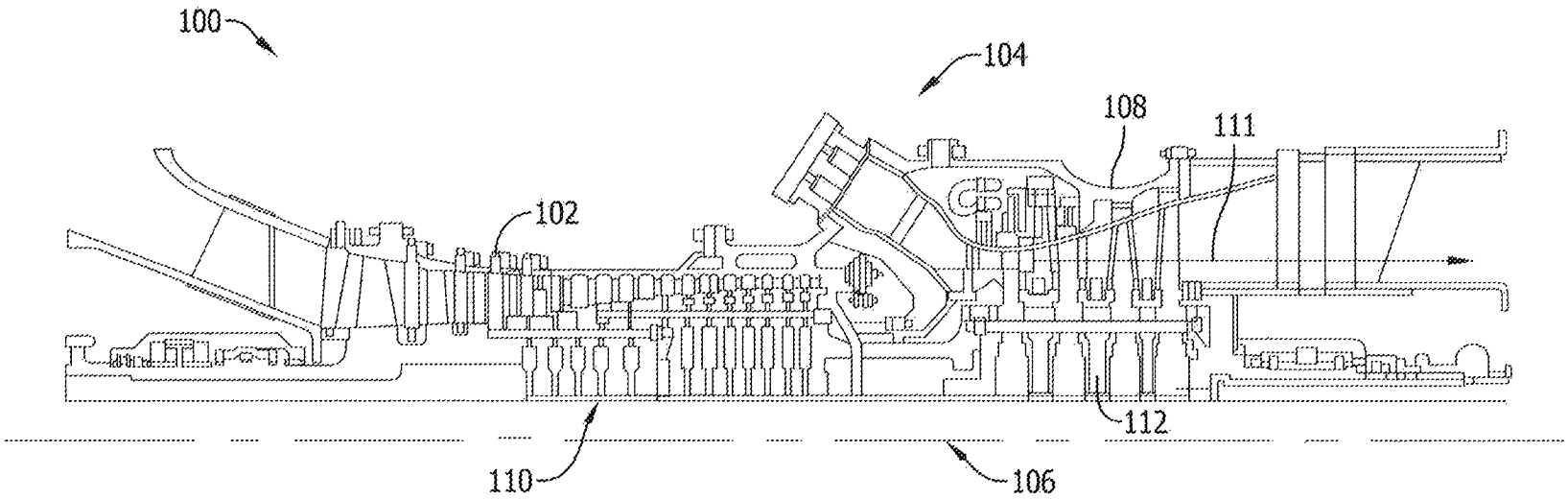
FIG. 1 is a schematic illustration of an exemplary gas turbine engine.

FIG. 1 is a schematic illustration of an exemplary gas turbine engine 100. Engine 100 includes a compressor assembly 102 and a combustor assembly 104. Engine 100 also includes a turbine 108 and a common compressor/turbine shaft 110 (sometimes referred to as a rotor 110). Combustion gases are channeled through engine 100 from combustor assembly 104 through turbine 108 along a hot gas path 111.

In operation, air flows through compressor assembly 102 such that compressed air is supplied to combustor assembly 104. Fuel is channeled to a combustion region and/or zone (not shown) that is defined within combustor assembly 104 wherein the fuel is mixed with the air and ignited. Combustion gases generated are channeled to turbine 108 wherein gas stream thermal energy is converted to mechanical rotational energy. Turbine 108 includes one or more rotor wheels 112 (shown in FIG. 2) that are coupled to rotor 110, for rotation about an axis 106.

Figure 2:
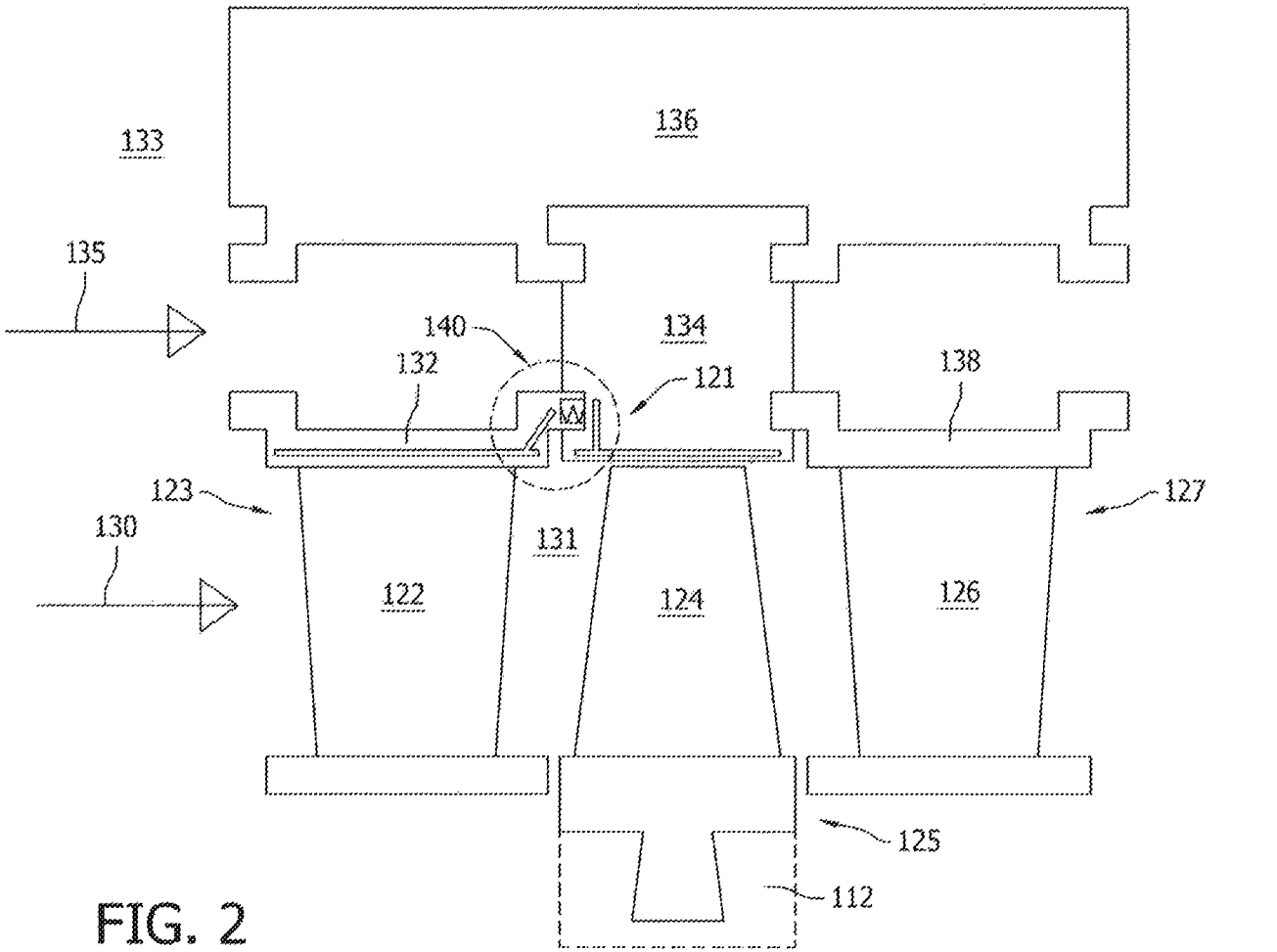
FIG. 2 is an enlarged schematic side sectional view of a portion of the gas turbine engine illustrated in FIG. 1.
Figure 3:
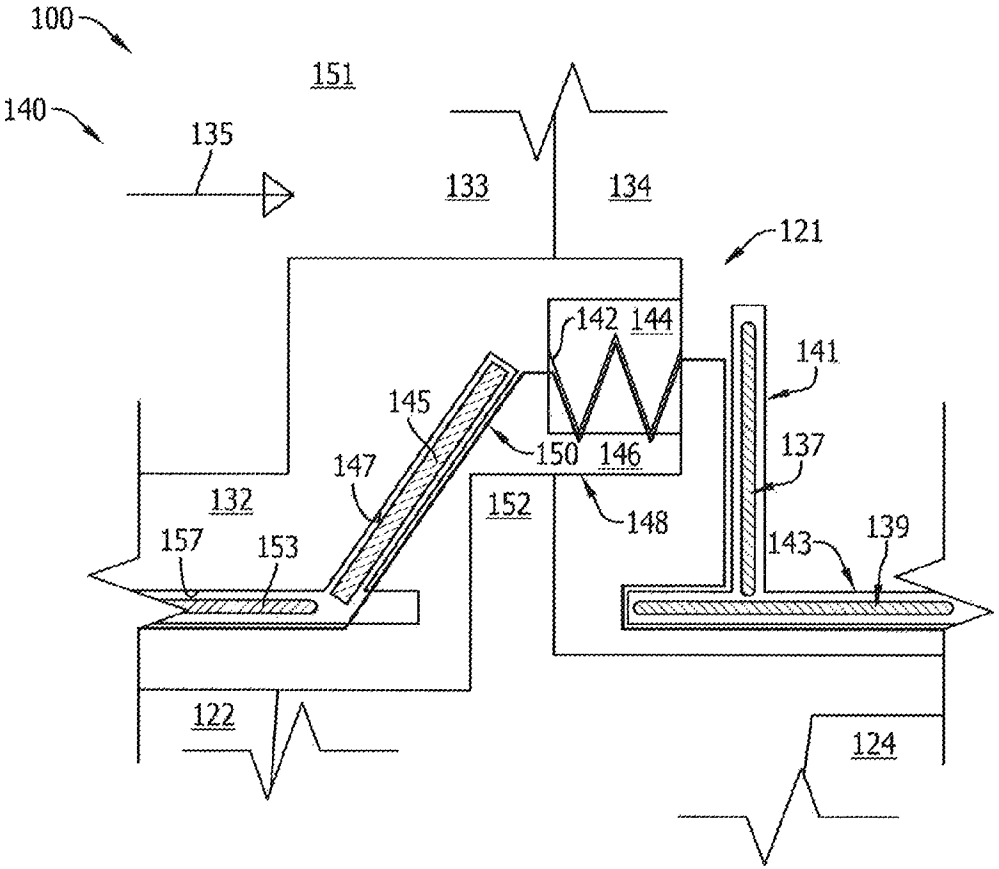
FIG. 3 (PRIOR ART)
FIG. 3 is an enlarged view of a portion of the gas turbine engine illustrated in FIG. 2, and includes a known sealing system.

FIG. 2 is an enlarged schematic side sectional view of a portion 120 of gas turbine engine 100. FIG. 3 is an enlarged view of engine portion 120 and includes a known sealing system 121. In an exemplary engine 100, a plurality of nozzle vanes 122 are spaced circumferentially about axis 106 (shown in FIG. 1) to define a first nozzle stage 123. Likewise, a plurality of vanes 126 are arranged circumferentially about axis 106, to define a second nozzle stage 127. A plurality of rotor blades 124 is coupled to a wheel 112 (also shown in FIG. 1) to define a first rotor stage 125. An exemplary nozzle vane 122 is coupled to, and is supported by a vane support 132. An exemplary nozzle vane 126 is coupled to, and is supported by a vane support 138. Vane supports 132 and 138 are coupled to a shroud 134 which is coupled to an inner turbine shell ("ITS") 136. Vane support 132 and shroud 134 are static non-rotating components of gas turbine engine 100. During operation of engine 100, a flow 130 of hot combustion gases passing through nozzle stage 123, rotor stage 125 and nozzle stage 127, defines a hot gas path 131.

As illustrated in FIG. 3, in at least some engines 100, a plurality of vane supports 132 are circumferentially-spaced around axis 106 (shown in FIG. 1), forming a segmented, annular arrangement of vane supports 132. Seal members 137 and 139 are located in seal recesses 141 and 143. Seal members 137 and 139 and corresponding seal recesses 141 and 143 have any configuration that enables engine 100 to function as described. Similarly, a plurality of shrouds 134 are circumferentially-spaced about axis 106 and a plurality of vane supports 138 are circumferentially arranged around axis 106. Engine 100 also includes a seal member 145 received in a recess 147, and a seal member 153 received in a recess 157. Vane support 132 is coupled to shroud 134 via a coupling region 140. In an exemplary embodiment, a cooling air flow 135 is channeled into an ITS side 133 from a supply (not shown) of cooling air, using any suitable structures that enable sealing system 121 to function as described herein. Seal members 137 and 139 in part facilitate establishing a pressure boundary 150, that separates hot gas path 131 from a relatively lower-temperature, but higher-pressure region 151 that is radially outward of pressure boundary 150, wherein higher-pressure region 151 is created at least in part by cooling air flow 135. Collectively, seal members 137, 139, 145, and 153 facilitate prevention of leakage of cool purge gases from region 151 past pressure boundary 150 and into hot gas path 111 (shown in FIG. 1).

As best illustrated in FIG. 3, coupling region 140 includes a compliant seal member 142 located in a recess 144 defined within a flange 146 extending axially from vane support 132. Flange 146 is received within a recess 148 defined within shroud 134. In one embodiment, compliant seal member 142 has a "W"-shaped cross-sectional configuration, and is maintained under substantially constant compression. Collectively, compliant seal member 142 and seal members 137 and 139 define in part a pressure boundary 150 that extends from vane support 132 to shroud 134, through to vane support 138. Pressure boundary 150 facilitates confining hot combustion gas flow 130 to regions of gas turbine engine 100 that tolerate elevated temperatures, and facilitates isolating less temperature-tolerant components, such as ITS 136, from hot combustion gas flow 130.

In at least some known engines 100, however, an axial gap 152 is defined between adjacent static components, such as vane support 132 and shroud 134. In at least some known engines 100, a pressure differential across pressure boundary 150 is sufficiently large that a pressure on an ITS side 133 will under normal conditions always exceed a pressure within hot gas path 131. Typically, surfaces within gap 152 and radially inward portions of flange 146 and recess 148 are neither coated with a thermal barrier coating nor are actively cooled. A pressure within gap 152 is typically approximate an average pressure within gas path 131. However, nozzle vanes 122 and/or blades 124 can cause localized pressure variations that can result in local hot gas ingestion into gap 152. To facilitate prevention of gas ingestion, purge air flow must be provided to raise pressure within gap 152 to preclude gas ingestion into gap 152 and/or to dilute the hot gas ingestion to facilitate lowering a temperature within gap 152 to a level tolerable to structures defining gap 152. Pressure boundary 150 is defined to extend around gap 152. As such, cooling air flow 135 must be of sufficient volume and pressure to ensure that hot combustion gases are purged from gap 152 to facilitate preventing heat-induced damage to temperature sensitive components. However, the supply of cooling air flow 135 to purge gap 152 and/or dilute hot gas ingested into gap 152 results in a reduced efficiency of engine 100.

Figure 4:
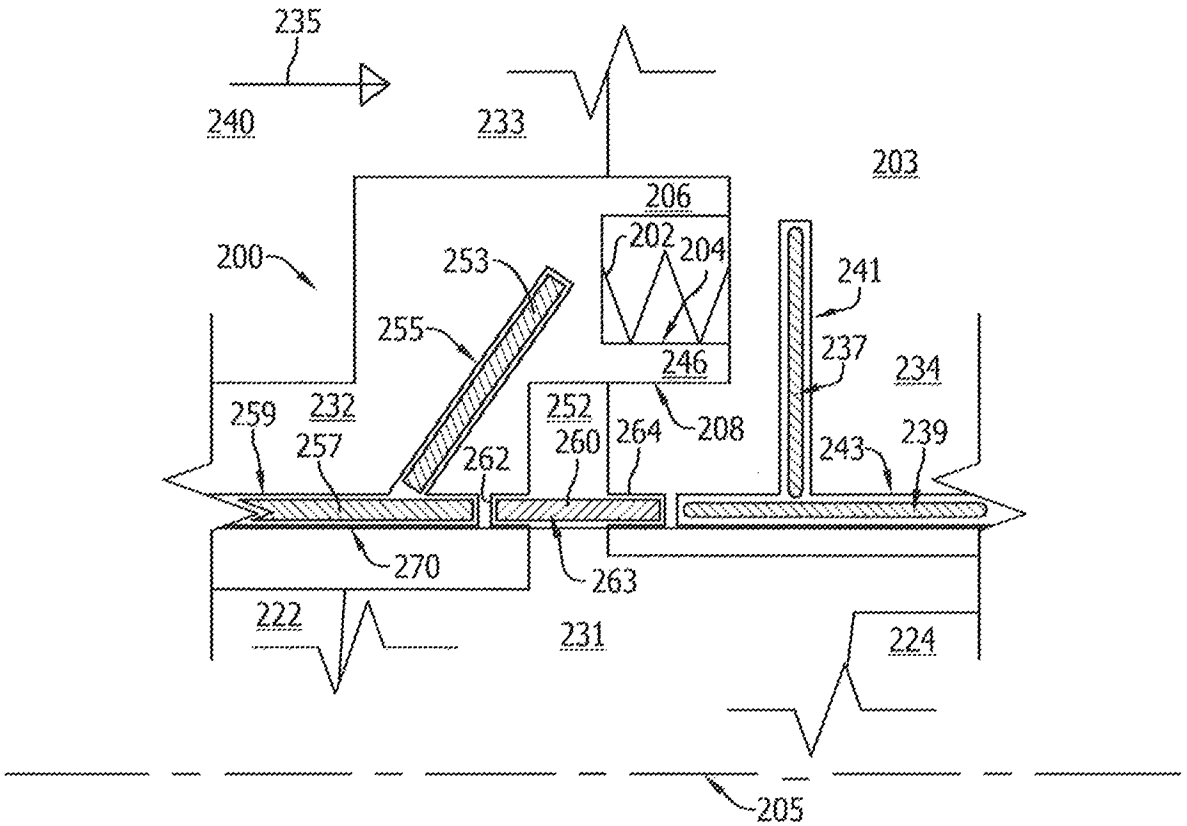
FIG. 4 is an enlarged schematic, side-sectional view of a portion of the gas turbine engine illustrated in FIG. 1, and including an exemplary sealing system.

FIG. 4 illustrates an exemplary sealing system 200 for an engine 203. As described above, a coupling region 240 includes a vane support 232 coupled to a vane 222, and a shroud 234 located radially outwardly from rotor blade 224. A gap 252 is defined between vane support 232 and shroud 234. To bridge gap 252, a seal member 260 is received within a recess 262 defined within vane support 232 and a corresponding recess 264 defined within shroud 234. In the exemplary embodiment, recesses 262 and 264 are defined any distance from a hot gas path 231 that enables system 200 to function as described herein. Moreover, in an exemplary embodiment, recesses 262 and 264 are each arcuate, and define, in part, a circumferential path around an axis 205 of engine 203. In one embodiment, recesses 262 and 264, and seal member 260 are adjacent to hot gas path 231. Moreover, in an embodiment, recesses 262 and 264 are oriented such that seal member 260 extends from recess 262 to recess 264 in an orientation that is substantially parallel to axis 205. More specifically, seal member 260 includes a sealing face 263 that extends substantially parallel to an engine axis 205. In addition, in one embodiment, system 200 includes seal members 237 and 239, inserted at least partially into corresponding seal recesses 241 and 243, wherein seal members 237 and 239 are similar to seal members 137 and 139, as described hereinabove and shown in FIG. 3. System 200 also includes seal members 253 and 257, inserted at least partially into corresponding seal recesses 255 and 259, wherein seal members 253 and 257 are similar to seal members 145 and 153, respectively, as described hereinabove, and shown in FIG. 3. In one embodiment, system 200 includes a supplementary compliant seal area 206, that includes a compliant seal member 202 positioned within a recess 204 defined in a flange 246 of vane support 232. Flange 246 is received within a recess 208 defined within shroud 234. In the exemplary embodiment, seal member 202 is a "W-shaped" compression-style seal member. As used herein, the term "compression-style" refers to a seal member that is maintained in a constant state of compression in order to provide sealing between adjacent members.

In one embodiment, seal member 260 cooperates with seal members 237 and 239 to define in part a pressure boundary 270 extending between a cooling air flow 235 in an ITS side 233, and hot gas path 231 located radially inwardly of pressure boundary 270. In the exemplary embodiment, pressure boundary 270 extends continuously in a direction that is substantially parallel to axis 205. Seal member 260 bridges gap 252 to facilitate preventing ingestion of hot combustion gases from hot gas path 231 into gap 252. Use of seal members 260 further facilitates simplification of gas turbine engine design. For example, nozzle vanes 222 may be supported from an inner turbine shell (not shown), rather than from shrouds, such as shrouds 234. Moreover, the use of seal members 260 enables shrouds to be used that include more simplified tile- or plate-like configurations than is possible in engines that do not use seal members 260.

Figure 5:
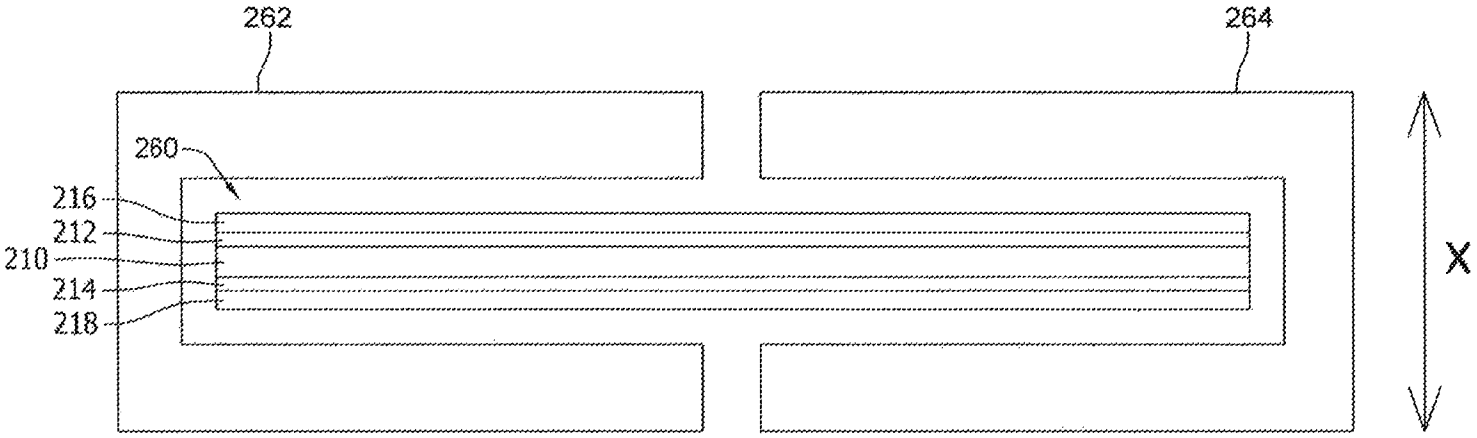
FIG. 5 is a detailed sectional view of an exemplary seal member for use in the sealing system illustrated in FIG. 4.

FIG. 5 is a detailed sectional view of seal member 260. In the exemplary embodiment, seal member 260 is laminated. A seal cloth substrate 210 is surrounded by shim layers 212 and 214. In an alternative embodiment, seal cloth substrate 210 is omitted, and layers 212 and 214 are coupled together directly.

A further shim layer 216 is adjacent shim layer 212 and a further shim layer 218 is adjacent shim layer 214. In the exemplary embodiment, a plurality of seal members 260 are spaced circumferentially about axis 205, such that each seal member 260 has an arcuate configuration. In one embodiment, two seal members 260, each extending approximately one hundred eighty degrees (180°), are provided. In another embodiment, four seal members 260, each extending approximately ninety degrees (90°), are provided. In other embodiments, any number of seal members 260 is used that enables system 200 to function as described herein. In the embodiment shown in FIG. 5, the direction indicated by the X arrow is a radial direction substantially perpendicular to axis 205 (shown in FIG. 4).

In system 200, seal member 260 is defined between vane support 232 and shroud 234, such that vane support 232 is upstream of shroud 234. In an alternative embodiment, seal member 260 is positioned between shroud 234 and a downstream nozzle support (not shown). That is, seal members 260 may be used on both up- and downstream regions of shroud 234.

In the exemplary embodiment, cloth substrate 210 is fabricated from a woven metal material, such as a high-temperature nickel-cobalt alloy, or any other suitable material that enables system 200 to function as described herein. In one embodiment, cloth substrate 210 includes at least two separate layers of cloth material. In alternative embodiments, more or less layers of cloth material may be used. Moreover, in the exemplary embodiment, shim layers 212, 214, 216, and 218 are each fabricated from stainless steel, or any other suitable material that enables system 200 to function as described herein. In one embodiment, shim layers 212 and/or 214 are spot-welded to cloth substrate 210 and/or to shim layers 216 and 218, respectively. Seal member 260 accommodates potential misalignment of vane support 232 and shroud 234, while facilitating prevention of ingestion of hot combustion gases into gap 252. In an exemplary embodiment, shim layers 212 and/or 214 are fabricated from the same material as shim layers 216 and/or 218, for example, a high-temperature cobalt alloy. In alternative embodiments, any suitable material or materials may be used to fabricate shim layers 212, 214, 216, and 218. In an exemplary embodiment, shim layers 212 and/or 214 have different thicknesses extending in a direction X, than shim layers 216 and/or 218. In one embodiment, seal member 260 is provided with active cooling, in the form of one or more gas flow paths (not shown) defined between adjacent layers of seal member 260, such that flow of a portion of cooling air flow 235 from ITS side 233 of seal member 260 towards hot gas path 231 is facilitated.

Figure 6:
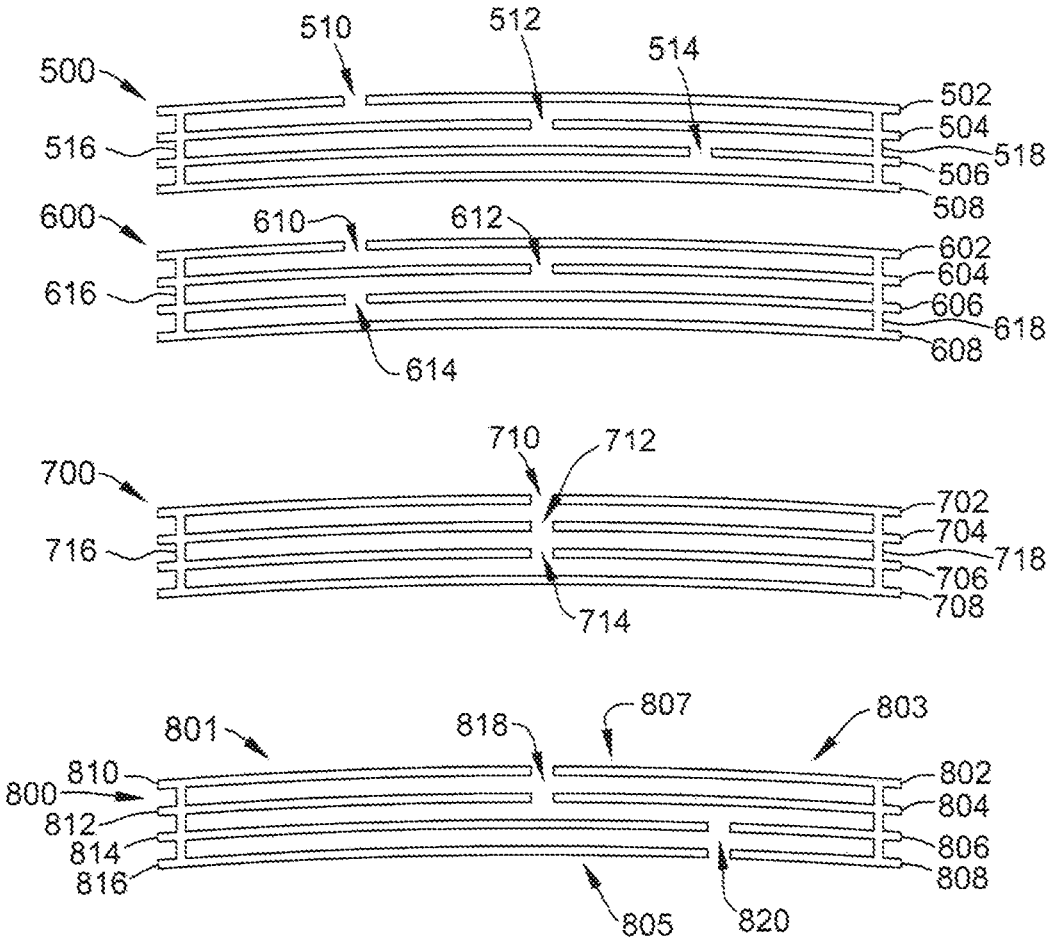
FIG. 6 is a schematic illustration of alternative exemplary seal members for use in the sealing system shown in FIG. 4.
Figure 7:
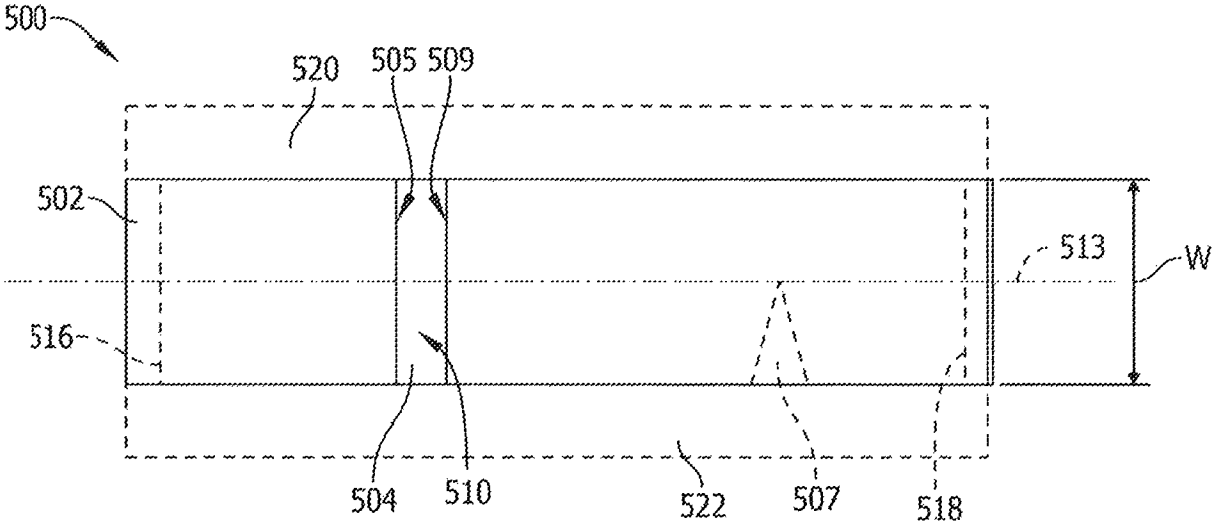
FIG. 7 is a top view of one of the exemplary seal members shown in FIG. 6.

FIG. 6 is a schematic illustration of exemplary alternative seal members 500, 600, 700, and 801 and 803 that can be used in sealing system 200 shown in FIG. 4. Seal member 500 is illustrated in a top view in FIG. 7. Seal member 500 includes layers 502, 504, 506, and 508. In the exemplary embodiment, layers 502, 504, 506, and 508 are fabricated from any suitable material that enables sealing system 200 to function as described herein. While four layers are shown in FIG. 7, in alternative embodiments, any number of layers is used that enables sealing system 200 to function as described herein. Layers 502-508 are coupled together using any suitable coupling mechanism, such as welds 516 and 518.

In the exemplary embodiment of FIGS. 6 and 7, seal member 500 includes one or more stress relief regions 510, 512, and 514 defined in one or more of layers 502-506. Stress relief regions 510, 512, and/or 514 provide areas of increased flexibility to accommodate stresses created when seal member 500 is bent during installation within engine 203 (shown in FIG. 4). In the exemplary embodiment, if seal member 500 includes multiple layers, the lowermost layer, such as layer 508, does not include stress relief regions, such that a complete layer is provided to facilitate sealing.

In the exemplary embodiment, each of stress relief regions 510, 512, and 514 is defined as a cut or interruption that extends across a complete width W of a respective layer 502-506. In an alternative embodiment, each stress relief region 510, 512, and/or 514 may include any configuration that enables seal member 500 to function as described herein. For example, each cut may have side edges 505 and 509 (shown in FIG. 7) that extend substantially perpendicular to a centerline 513 of seal member 500. Alternatively, one or both of side edges 505 and 509 may extend at an oblique angle relative to centerline 513. For example, a stress relief region 507 may be defined as a "V"-shaped cutout region that extends only partially across width W of seal member 500. More specifically, each stress relief region 507, 510, 512, and/or 514 may have any configuration and placement that enables seal member 500 to function as described herein. In addition, stress relief regions 507, 510, 512, and/or 514 may be defined using any suitable method, including but not limited to, die cutting and stamping that enables sealing system 200 to function as described herein. In FIGS. 6 and 7, seal member 500 is illustrated having layers 502-508 of substantially equal length. In alternative embodiments, as described hereinbelow, seal member 500 may have layers 502-508 of unequal length, for facilitating coupling of adjacent seal members 500 circumferentially within engine 203 (shown in FIG. 4).

In the exemplary embodiment, seal member 500 may include laterally-extending spring members 520, 522 (shown in FIG. 7) that extend from one or more of layers 502-508. Spring members 520, 522 facilitate maintaining sealing contact between seal member 500 and recesses 262 and 264 (shown in FIG. 5). Spring members 520 and 522 have any cross-sectional configuration (when viewed in a direction parallel to centerline 513) that enables seal member 500 to function as described herein, such as, but not limited to, a "V" or "W" configuration. In addition, one or both of spring members 520 and 522 may be integrally formed with one or more of layers 502-508, or coupled to one or more of layers 502-508. In the exemplary embodiment, seal member 500 includes two spring members 520 and 522. In alternative embodiments, any number of spring members may be used that enables sealing system 200 to function as described herein.

FIG. 6 also illustrates a seal member 600 that may be used in sealing system 200 (shown in FIG. 4). Seal member 600 includes layers 602, 604, 606, and 608. Each layer 602-608 may be fabricated from any suitable material that enables sealing system 200 to function as described herein. Layers 602-608 are coupled using any suitable coupling method, including but not limited to, welds 616 and 618. Seal member 600 also includes stress relief regions 610, 612, and 614. In general, each stress relief region 610, 612, and/or 614 may have any configuration and may be oriented on seal member 600 at any desired location that enables sealing system 200 to function as described herein.

FIG. 6 also shows a seal member 700 that may be used in sealing system 200 (shown in FIG. 4). Seal member 700 includes layers 702, 704, 706, and 708. Each layer 702-708 may be fabricated from any suitable material or combination of materials that enables sealing system 200 to function as described herein. Seal member 700 includes aligned stress relief regions 710, 712, and 714. In the exemplary embodiment, layers 702-708 are coupled together using any suitable coupling method, including but not limited to welds 716 and 718. In general, each stress relief region 710, 712, and/or 714 may have any configuration and may be oriented on seal member 700 at any desired location that enables sealing system 200 to function as described herein.

In each of the exemplary embodiments shown in FIG. 6, each of seal members 500, 600, and 700 includes multiple layers. In each of seal members 500, 600, and 700, the lowermost layer 508, 608, and 708 is not provided with stress relief regions and accordingly is uninterrupted along its length. Layers 508, 608, and 708 are those layers of seal members 500, 600, and 700 that are radially closest to axis 205 (shown in FIG. 4) of engine 203 (shown in FIG. 4).

As described above, in the exemplary embodiments, a plurality of seal members 500, 600, and/or 700 are oriented circumferentially around axis 205 within engine 203 (shown in FIG. 4). Accordingly, an exemplary seal member-to-seal member interface 800 between adjacent seal members 801 and 803 is illustrated in FIG. 6. Interface 800 includes a ship lap configuration. Seal member 801 includes layers 810, 812, 814, and 816. Seal member 801 further includes an extension portion 805. Seal member 803 includes layers 802, 804, 806, and 808. Seal member 803 further includes an extension portion 807. When a sealing system 200 (shown in FIG. 4) is assembled using seal members 801 and 803, seal members 801 and 803 are inserted into a recess 264 (shown in FIG. 5), in the orientation shown in FIG. 6, such that gaps 818 and 820 define a labyrinthine path further slowing leakage of purge gases past seal members 801 and 803. In the exemplary embodiment, seal members 801 and 803 are not coupled together where extension portions 805 and 807 overlap. In alternative embodiments, any interface configuration may be used that enables sealing system 200 to function as described herein.

The methods and systems described herein provides several advantages over known methods of sealing between static components in a gas turbine engine. For example, the sealing system described herein facilitates defining a pressure boundary within a gas turbine engine that is closer to an engine hot gas path, than are pressure boundaries defined by known sealing systems. The sealing system described herein facilitates the use of simplified sealing structures between adjacent static turbine components. Moreover, the sealing system described herein facilitates controlling outflow of cooler purge gases into gaps defined between components in a gas turbine engine, towards facilitating an increase in turbine efficiency.

Exemplary embodiments of a method and a system for sealing between static components of a gas turbine engine are described above in detail. The method and system are not limited to the specific embodiments described herein, but rather, components of systems and/or steps of the methods may be utilized independently and separately from other components and/or steps described herein. For example, the method may also be used in combination with other rotary machine systems and methods, and are not limited to practice only with gas turbine engines as described herein. Rather, the exemplary embodiment can be implemented and utilized in connection with many other rotary machine applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the methods and systems described herein, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the disclosure has been described in terms of various specific embodiments, those skilled in the art will recognize that the disclosure can be practiced with modification within the spirit and scope of the claims.

What is claimed is:

1. A method for assembling a gas turbine, said method comprising:

providing a first component of a gas turbine, wherein the first component includes a first recess defined therein that is adjacent to a hot gas path defined through the gas turbine;

providing a second component of a gas turbine, wherein the second component is adjacent to the first component, and wherein the second component includes a second recess that is defined adjacent to the hot gas path;

orienting a first seal member within the first and second recesses, wherein the first recess defines a first circumferential path about a turbine axis, wherein the second recess defines a second circumferential path about the turbine axis, and wherein the seal member includes a sealing face that extends in a direction substantially parallel to the turbine axis, wherein the first seal member includes a plurality of seal layers;

defining a seal member-receiving recess within at least one of the first and second components, such that the first and second recesses extend radially between the turbine axis and the seal member-receiving recess; and inserting a second seal member within the seal-member-receiving recess.

2. A method in accordance with claim 1, wherein said method further comprises defining at least one stress relief region in at least one seal layer for facilitating flexing of the first seal member during orientation of the first seal member within the first and second recesses.

3. A method in accordance with claim 2, wherein defining at least one stress relief region comprises defining at least one stress relief region in each of at least two of the plurality of seal layers.

4. A method in accordance with claim 3, wherein defining at least one stress relief region in each of at least two of the plurality of seal layers comprises orienting at least one stress relief region in a first layer in substantial alignment with at least one stress relief region in at least a second layer.

5. A method in accordance with claim 3, wherein defining at least one stress relief region in each of at least two of the plurality of seal layers comprises orienting the stress relief regions such that no stress relief regions are aligned with each other.

6. A method in accordance with claim 2, wherein defining at least one stress relief region in at least one seal layer comprises defining at least one interruption in at least one seal layer that extends across a complete width of the at least one seal layer.

7. A method in accordance with claim 1, wherein said method comprises:

defining the seal member-receiving recess within at least one of adjoining portions of the first and second components; and inserting the second seal member as a compression-style seal member within the seal-member-receiving recess.

8. A method in accordance with claim 1, wherein said method comprises providing the first seal member with at least one laterally-extending spring member for facilitating sealing contact of the first seal member within the first and second recesses.

9. A method in accordance with claim 1, wherein said method comprises orienting the first circumferential path to be substantially concentrically-aligned with the second circumferential path.

10. A method in accordance with claim 9, wherein said method comprises orienting a second seal member within the first and second recesses adjacent to the first seal member, wherein the first and second seal members each include an extension portion, such that the extension section of the first seal member overlaps the extension portion of the second seal member.

11. A system for use in sealing between components within a gas turbine, said system comprising:

a first recess defined in a first component in a gas turbine, wherein said first recess is located proximate a hot gas path defined through the gas turbine, and wherein said first recess defines a first circumferential path about a turbine axis;

a second recess defined in a second component located adjacent said first component, wherein said second recess is located proximate the hot gas path, and wherein said second recess defines a second circumferential path about the turbine axis;

a first seal member oriented within said first and second recesses, said first seal member including a sealing face that extends in a direction substantially parallel to the turbine axis, wherein said first seal member includes a plurality of seal layers;

a seal member-receiving recess defined within at least one of said first and second components, such that said first and second recesses are located radially between the turbine axis and said seal member-receiving recess; and a second seal member oriented within said seal-member-receiving recess.

12. A system in accordance with claim 11, wherein said system further comprises at least one stress relief region defined in said at least one seal layer for facilitating flexing of the first seal member during orientation of said first seal member within the first and second recesses.

13. A system in accordance with claim 12, wherein said at least one stress relief region comprises at least one stress relief region defined in each of at least two of said plurality of seal layers, and wherein at least one stress region defined in a first seal layer is oriented in substantial alignment with at least one stress relief region defined in at least a second seal layer.

14. A system in accordance with claim 13, wherein said at least one stress relief region comprises at least one stress relief region defined in each of at least two of said plurality of seal layers, and wherein said stress relief regions are oriented such that no stress relief regions are aligned with each other.

15. A system in accordance with claim 12, wherein said at least one stress relief region comprises at least one interruption in said at least one seal layer that extends across a complete width of said at least one seal layer.

16. A system in accordance with claim 12, wherein said at least one stress relief region comprises at least one cutout region defined in said at least one seal layer that extends partially across a width of said at least one seal layer.

17. A system for use in sealing between components within a gas turbine, said system comprising:

a first recess defined in a first component in a gas turbine, wherein the first recess is located proximate a hot gas path defined through the gas turbine, and wherein the first recess defines a first circumferential path about a turbine axis;

a second recess defined in a second component located adjacent the first component, wherein the second recess is located proximate the hot gas path, and wherein the second recess defines a second circumferential path about the turbine axis;

a first seal member oriented within the first and second recesses, said first seal member including a sealing face that extends in a direction substantially parallel to the turbine axis, wherein said first seal member includes a plurality of seal layers;

a seal member-receiving recess defined within one of adjoining portions of said first and second components, such that said first and second recesses are located radially between the turbine axis and said seal member-receiving recess; and a second, compression-style seal member oriented within the seal-member-receiving recess.

18. A system in accordance with claim 11, wherein said first seal member comprises at least one laterally-extending spring member for facilitating sealing contact of said first seal member within the first and second recesses.

19. A system in accordance with claim 11, wherein the first circumferential path is oriented concentrically with the second circumferential path.

20. A gas turbine system, said system comprising:

a compressor section;

a combustor assembly coupled to said compressor section; and a turbine section coupled to said compressor section, wherein said turbine section includes a sealing sub-system for use in sealing between a first component and a second component, wherein said sealing sub-system comprises:

a first recess defined in a first component in said turbine section, wherein the first recess is located proximate a hot gas path defined through said turbine section, and wherein the first recess defines a first circumferential path about a turbine axis;

a second recess defined in a second component adjacent said first component, wherein the second recess is located proximate the hot gas path, and wherein the second recess defines a second circumferential path about the turbine axis;

a first seal member oriented within the first and second recesses, said first seal member including a sealing face that extends in a direction substantially parallel to the turbine axis;

a seal member-receiving recess defined within one of adjoining portions of said first and second components, such that said first and second recesses are located radially between the turbine axis and said seal member-receiving recess; and a second, compression-style seal member oriented within said seal-member-receiving recess.

* * * * *